US012747595B2

(12) United States Patent
Boucké

(10) Patent No.: US 12,747,595 B2
(45) Date of Patent: Sep. 29, 2026

(54) DECORATIVE PANEL AND METHOD OF PRODUCING SUCH A PANEL

(71) Applicant: I4F Licensing NV, Turnhout (BE)

(72) Inventor: Eddy Alberic Boucké, Menen (BE)

(73) Assignee: i4F Licensing NV, Turnhout (BE)

( * ) Notice: Subject to any disclaimer, the term of this patent is extended or adjusted under 35 U.S.C. 154(b) by 363 days.

(21) Appl. No.: 17/631,018

(22) PCT Filed: Jul. 28, 2020

(86) PCT No.: PCT/EP2020/071313
§ 371 (c)(1),
(2) Date: Jan. 28, 2022

(87) PCT Pub. No.: WO2021/018918
PCT Pub. Date: Feb. 4, 2021

(65) Prior Publication Data

US 2022/0259869 A1 Aug. 18, 2022

(30) Foreign Application Priority Data

Jul. 29, 2019 (NL) ..... 2023587

(51) Int. Cl.
*E04F 15/02* (2006.01)
*E04F 13/08* (2006.01)
*E04F 15/10* (2006.01)

(52) U.S. Cl.
CPC .... *E04F 15/02038* (2013.01); *E04F 13/0894* (2013.01); *E04F 15/107* (2013.01); *E04F 2201/0153* (2013.01); *E04F 2201/023* (2013.01); *E04F 2201/042* (2013.01); *E04F 2201/043* (2013.01)

(58) Field of Classification Search
CPC ..... E04F 15/02038; E04F 2201/0146; E04F 15/02033; E04F 15/107; E04F 13/0894; E04F 2201/023; E04F 2201/042; E04F 2201/043; B32B 21/02; B32B 2471/00
See application file for complete search history.

(56) References Cited

U.S. PATENT DOCUMENTS 8,544,232 B2 10/2013 Wybo et al.
9,314,936 B2 4/2016 Pervan
(Continued)

FOREIGN PATENT DOCUMENTS

BE 1027024 A1 8/2020
CN 104411900 A 3/2015
(Continued)

*Primary Examiner* — Brian E Glessner
*Assistant Examiner* — Daniel J Kenny
(74) *Attorney, Agent, or Firm* — The Webb Law Firm

(57) ABSTRACT

The invention relates to a decorative panel, in particular a floor panel, ceiling panel or wall panel. The invention also relates to a decorative covering, in particular a decorative floor covering, decorative ceiling covering, or decorative wall covering, including a plurality of mutually coupled decorative panels according to the invention. The invention further relates to a core for use in a panel according to the invention. The invention additionally relates to a method of producing a decorative panel, in particular a decorative panel according to the invention. The invention also relates to an extruded for use in said method according to the invention.

20 Claims, 4 Drawing Sheets

(56) References Cited

U.S. PATENT DOCUMENTS

| | | | | |
|---|---|---|---|---|
| 9,482,015 | B2 | 11/2016 | Pervan | |
| 10,233,656 | B2 * | 3/2019 | Courey | B32B 27/304 |
| 10,267,046 | B2 | 4/2019 | Bouckéet al. | |
| 10,344,485 | B2 | 7/2019 | Muehlebach | |
| 11,242,687 | B2 | 2/2022 | Bouckéet al. | |
| 2007/0193180 | A1 | 8/2007 | Plante | |
| 2008/0241440 | A1 | 10/2008 | Bauer | |
| 2009/0308001 | A1 | 12/2009 | Wu et al. | |
| 2010/0021718 | A1 * | 1/2010 | Vos | B32B 27/08<br>428/317.9 |
| 2011/0045250 | A1 * | 2/2011 | De Zen | B29C 48/001<br>428/167 |
| 2016/0153200 | A1 * | 6/2016 | Pervan | E04F 15/102<br>52/582.2 |
| 2018/0085988 | A1 | 3/2018 | Pitsch | |
| 2020/0353722 | A1 * | 11/2020 | Naeyaert | B32B 5/16 |
| 2025/0012098 | A1 | 1/2025 | Schacht et al. | |

FOREIGN PATENT DOCUMENTS

| | | | |
|---|---|---|---|
| EP | 3105392 | A0 | 12/2016 |
| JP | 200319770 | A | 1/2003 |
| JP | 3166171 | U | 2/2011 |
| JP | 2012513548 | A | 6/2012 |
| JP | 2019105157 | A | 6/2019 |
| PT | 109513 | A | 1/2017 |
| WO | 2015130169 | A1 | 9/2015 |
| WO | 2018215550 | A1 | 11/2018 |

* cited by examiner

DECORATIVE PANEL AND METHOD OF PRODUCING SUCH A PANEL

CROSS-REFERENCE TO RELATED APPLICATIONS

This application is the United States national phase of International Application No. PCT/EP2020/071313 filed Jul. 28, 2020, and claims priority to The Netherlands Patent Application No. 2023587 filed Jul. 29, 2019, the disclosures of which are hereby incorporated by reference in their entirety.

BACKGROUND OF THE INVENTION

Field of the Invention

The invention relates to a decorative panel, in particular a floor panel, ceiling panel or wall panel. The invention also relates to a decorative covering, in particular a decorative floor covering, decorative ceiling covering, or decorative wall covering, comprising a plurality of mutually coupled decorative panels according to the invention. The invention further relates to a core for use in a panel according to the invention. The invention additionally relates to a method of producing a decorative panel, in particular a decorative panel according to the invention. The invention also relates to an extruded for use in said method according to the invention.

Description of Related Art

Decorative coverings, in particular floor coverings, are more often formed by a plurality of interconnected panels, wherein each panel having an extruded core of thermoplastic based core material, as these coverings typically have relatively good waterproof properties. An example of such a covering is known from U.S. Pat. No. 8,544,232, which discloses a wall-covering panel with an extruded support plate made from synthetic plastic material. In consideration of the increasingly stricter ecological requirements or motivations for saving materials, weight and energy, amongst others, the need arises for thinner panels, yet still with sufficient strength and shape retention and with sufficiently strong coupling or connecting profiles at their edges of the panels or tiles with adjacent panels or tiles. An example of a substrate which may be used to construct various articles with different features of energy saving, decoration and protection as well as simple installation for various applications is disclosed in US2009/0308001.

SUMMARY OF THE INVENTION

It is a first object of the present invention to provide a relatively light-weight decorative panel having relatively strong coupling profiles.

It is a second object of the present invention to provide a relatively light-weight decorative waterproof panel having relatively strong coupling profiles.

It is a third object of the present invention to provide a relatively light-weight decorative panel having an extruded core and having relatively strong coupling profiles.

It is a third object of the present invention to provide a relatively light-weight decorative panel which can be manufactured in a relatively efficient manner.

At least one of the aforementioned objects is achieved by the decorative panel, in particular a floor panel, ceiling panel or wall panel, according to the invention, comprising: a core provided with an upper side and a lower side, an optional decorative top structure, either directly or indirectly, affixed on said upper side of the core, a first panel edge comprising a first coupling profile, and a second panel edge comprising a second coupling profile being designed to engage interlockingly with said first coupling profile of an adjacent panel, both in horizontal direction and in vertical direction, a third panel edge comprising a third coupling profile, and a fourth panel edge comprising a fourth coupling profile being designed to engage interlockingly with said third coupling profile of an adjacent panel, both in horizontal direction and in vertical direction, wherein each panel edge defines at least one vertical plane (VP) perpendicular to a horizontal plane (HP), which horizontal plane (HP) is parallel to the core, wherein the core is provided with at least two vertically extending core grooves having a groove opening connected to the lower side and/or upper side of the core, wherein the entire part of the core grooves is arranged inside the vertical planes (VP) respectively defined by all panel edges, such the core grooves do not intersect any coupling profile of the first coupling profile, the second coupling profile, the third coupling profile, and the fourth coupling profile, wherein each core groove is defined by at least one groove wall, wherein, preferably, the core and the core grooves are formed by means of an extrusion process and/or by means of thermoforming. Preferably, that the lower side and/or upper side of the core and the groove walls of the core grooves have substantially the same surface texture.

The decorative panel according to the invention has several advantages. A first advantage is that the weight of the panel per $m^2$ of top surface is relatively low, leading to a light-weight panel, which is beneficiary from an economic, environmental and logistic point of view. The relatively low areal weight of the panel is realized by applying a plurality (two or more) of grooves in the upper side and/or lower side of the core, which reduces the amount of material used in the core and therefore in the panel as such. An important additional advantage of the decorative panel according to the invention is that the grooves are applied merely within a centre portion of (the lower side and/or upper side of) the core and not in the peripheral portion of (the lower side and/or upper side of) the core. The core grooves are therefore located at a distance from at least two coupling profiles, and preferably at least four coupling profiles, more preferably all coupling profiles. This means that the coupling profiles as such are not weakened by the grooves, and that the coupling profiles can be shaped in a relatively robust (unweakened) manner, which secures and allows two and more panels to be coupled to each other in a relatively firm, reliable and/or durable manner. A further advantage is that the grooves are formed during the extrusion process, preferably by making use of a deformable and/or displaceable die, also referred to as a mouth, of an extruder. During the formation of the grooves, the core is still liquified, which should be understood as viscous or paste-like, wherein the grooves are formed by deformation of the (still liquified) core. As indicated above, the formation of the core grooves is preferably realized by an extruder, but may also be realized (directly) downstream the extruder, for example by means of shaping tools, such as a stamp, as long as the core is still sufficiently liquified and therefore deformable. Both of these options are considered to make part of the same extrusion process. Although this is commonly less preferred for economic and efficiency reasons, it is also conceivable that after formation (extrusion) of the core, the core is subjected to an additional heating step, for example by making use of an oven, wherein the core is sufficiently liquified and/or kept in liquified state in order to subsequently form the core grooves in the core by position-selectively deforming (the upper side and/or lower side of) the core. This process step is also referred to as thermoforming. The time gap between the extrusion process and the thermoforming process may be zero, but may also be larger, in particular in the magnitude of seconds, minutes, hours, days, weeks, or even months. In the text below, including the claims as filed, the preferred extrusion process and typically less preferred thermoforming process are combined referred to as an extrusion process (or more briefly to "extrusion"). Apart from the fact that this production method is relatively (cost) efficient, since the formation of the core and the grooves can be realized in a single process step, an additional advantages is that the formation of grooves is not applied in a mechanical manner, e.g. by means of milling or sawing, and does therefore not lead to the undesired generation of dust particles during the application of the grooves. Such dust particles do not only pollute the production environment and the core as such, and therefore the panel as such, but also leads to unwanted health risks for production employees. Furthermore, the formation of the grooves during the extrusion process rather than to apply mill the grooves after generation of the core, leads to less material waste, which is beneficiary from an economic and environmental point of view. Moreover, since the grooves are applied by deforming core material (in liquified (viscous) state), the lower side and/or upper side of the core on one side and the groove walls of the core grooves on the other side preferably have substantially the same surface texture. This substantially the same surface texture is preferably a relatively smooth surface texture, more preferably without spines or other (sharp) protrusions. Surface texture, also known as surface finish or surface topography, is the nature of a surface as typically defined by the three characteristics of lay, surface roughness, and waviness. The surface texture of the upper side and/or the lower side of the core may or may not comprise small, local deviations (relief) of a surface from the perfectly flat ideal (a true plane), but may also be flat surfaces. The same relief or flatness may be applied to the groove walls of the core grooves, which is typically a result of the extrusion process. Preferably, the surface texture of the lower side and/or upper side of the core is such that another layer can be attached easily and durably to the core. This attachment of this at least one additional layer to the core can be realized e.g. by means of gluing, by means of welding, by means of printing, and/or by means of coating. Although both the lower side and the upper side of the core may be provided with core grooves, it is also imaginable, and typically preferable, that merely one side of the core is provided with core grooves, more preferably that merely the lower side of the core is provided with core grooves. The panel according to the invention may be rigid or may be flexible (resilient), or slightly flexible (semi-rigid). The panel according to the invention is configured to be coupled to one or more other (typically similar) panels in order to form a covering, in particular a floor covering, a wall covering, a ceiling covering, or a furniture covering.

By said "horizontal plane" (HP) is meant a (fictive) plane, which extends parallel to the core, and which may intersect the core. By said "vertical plane" (VP) is meant a (fictive) plane at a panel edge, wherein said vertical plane is perpendicular to said horizontal plane (HP). Typically, the vertical plane (VP) coincides with the outer part of a panel edge, which outer part is also referred to as joint edge as this joint edge is configured to engage or face a joint edge of an adjacent panel, in coupled condition of the panels. The joint edge typically has one or more joint surfaces which may be vertical, horizontal, angled, rounded, bevelled etcetera. In case a panel edge, in particular a joint edge, is configured to define a plurality of vertical planes (VP), for example one vertical plane (VP1) coinciding with a joint edge at or near the upper side of the core and one other vertical plane (VP2) coinciding with a or said joint edge at or near a lower side of the core, the core grooves are located at a distance of at least one vertical plane (VP1 and/or VP2), and preferably all vertical planes (VP1 and VP2). It is, however, imaginable that an outer end of the core grooves coincides with a vertical plane of a panel edge. The panel edge may also be interpreted as an edge zone (having a limited width) adjacent to the center portion of the panel. Here, it is also conceivable to indicate that at least one panel edge, preferably each panel edge, is configured to define a plurality of vertical planes (VP), wherein one vertical plane (VP1) coincides with the outer part of a panel edge and at least one other vertical plane (VP2) coincides with a part of a coupling profile of said edge, positioned closest to a centre portion of the core of the panel. Typically, said coupling profile extends from (and including) vertical plane VP1 to vertical plane VP2. It is also imaginable that at least one panel edge, preferably each panel edge, is configured to define a plurality of vertical planes (VP), wherein one vertical plane (VP-O) coincides with a top outer part of said panel edge and wherein at least one vertical plane (VP-I) coincides with a bottom outer part of said panel edge. Here, it is conceivable, and typically the case, that vertical plane VP1 and VP-O are coinciding planes. The same applies to vertical plane VP2 and VP-I, although a (small) distance between VP2 and VP-I may be applied, which is, for example, depicted in FIG. 2*a* and FIG. 3*a*. The core grooves are positioned at a distance from at least one of the aforementioned vertical planes, and preferably at least vertical planes VP-O and VP-I, and more preferably each of the vertical planes VP-O (VP1), VP-I, and VP-2. The core grooves are extending vertically in the core, which means that the core grooves extends from the groove opening connected to the lower side and/or upper side of the core, vertically toward an outer end (deepest point) of the groove wall. Typically, each core groove has an elongated shape, wherein each groove, as seen in its longitudinal direction, extends in a direction which coincides with or is parallel to the horizontal plane (HP) of the panel.

As the core of the panel according to the invention, as well as the core grooves formed therein, are preferably formed by means of extrusion, it is required (in that case) that the core is made is from a material which is extrudable and/or which was initially extrudable prior to formation of the core. Although ceramic and metal are suitable for extrusion and therefore also to produce a core of a panel according to the invention, the most preferred extrudable core material is based upon at least one polymer, in particular a thermoplastic or a thermoset. Other ingredients are typically mixed with said at least one polymer prior to or during the extrusion process.

The panel according to the invention may be used as indoor (interior) panel and/or as outdoor (exterior) panel.

During the extrusion process, if applied, it is conceivable to co-extrude together with the core at least one other layer, such as (at least a part of) the decorative layer. During the extrusion process, it is conceivable that core is provided at least two zones of different composition. Such zones may be obtained, for example, by means of co-extrusion. The different compositions in different zones may result in mutually different features, such as, for example, in respect to elasticity, colour, adherence, smoothness of the surface, processability and the like. Different compositions in different zones may, for example, be based upon different ratios between polymeric material, in particular thermoplastic material (like PVC and/or PET), and non-polymeric material, in particular filler, more in particular mineral filler (like chalk). For example, to this end, it is imaginable that the core layer is relatively stiff or rigid, and the other layer, preferably positioned underneath the core layer during normal use, is relatively flexible or soft.

In a preferred embodiment, the core groove depth (GD) of at least one core groove is at least 0.3 times a panel thickness (T), more preferably wherein the core groove depth (GD) of at least one core groove is larger than 0.4 times the panel thickness and smaller than 0.7 times the panel thickness. This preferred groove depth leads to a considerable material saving, while maintaining a relatively strong panel. This is in particular favourable in case the panel is used as floor panel as the floor panels should be able to exhibit serious impact resistance during normal use. Core grooves with a groove depth (GD) larger than 0.7 times the panel thickness, preferably at least 0.8 times the panel thickness T may be formed in wall panels or ceiling panels where the requirements on the impact resistance are much lower than for floor panels.

It is imaginable that the core groove depth (GD) of at least one core groove varies along the core groove length. Preferably, each core groove is defined by two terminal portions (outer ends) enclosing a centre portion, and wherein the core groove depth (GD) of the centre portion at least one core groove varies along the core groove length. At least one groove wall of at least one core groove has a waved surface. The changing groove depth (GD) along the core groove may seriously improve the acoustic properties (sound dampening properties) of the panel as such.

Preferably, the width of the groove opening of at least one core groove is larger than the width of an inner part of said core groove. Preferably, at least a part of at least one core groove has a trapezium-shaped cross-section, wherein core groove narrows down in an upward direction facing away from the groove opening. This converging shape of the core groove(s) towards the groove opening could further improve the acoustic properties (sound dampening properties) of the panel as such. Moreover, this embodiment allows to realize a serious material saving while keeping the contact surface of the lower side of the core to a backing layer (or separate subfloor) relatively large which is in favour of the stability, durability and the robustness of the panel.

It is imaginable that the width of the groove opening of at least one core groove is substantially equal to the width of an inner part of said core groove. This groove shape is typically relatively easy to realize during the extrusion process. In this embodiment, the core grooves comprises at least two core groove side walls oriented in parallel with respect to each other.

At least one core groove may be a discontinuous core groove. This means that the core groove is composed of a plurality of distant core groove segments which are typically situated in line.

It is imaginable that at least two core grooves may have mutually different shapes and/or dimensions. More in particular, it may be preferred that inner core grooves are formed with a smaller groove depth (GD) and/or smaller groove width (GW) than outer core grooves, wherein said inner grooves are located at a greater distance from a panel edge than said outer core grooves.

Typically the core grooves are air-filled. However, it is also imaginable that at least one core groove is filled with at least one solid and/or liquid material. Preferably, this filling material is cheaper than the polymer and/or other ingredients (additives) used in the core. Examples of a cheap filling material are solid wood, wood chips, wood dust, wood fibre, hemp fibre, and mineral fillers, such as chalk (calcium carbonate). By at least partially filling at least one core groove, and preferably all core grooves, the panel is provided different properties, such as for example an increased sound reduction.

It is also imaginable and even preferable that at least a number of core grooves, preferably all core grooves are filled with an elastic material, typically strip-shaped, preferably made from an anisotropic material, wherein said elastic material (co-)defines the lower side of the panel. The application of such a material could seriously increase the friction between the panel and an underlying subfloor, and hence could seriously improve the stability of the panel with respect to said subfloor. Preferably, said elastic material is merely present within the core groove(s), and hence does preferably not cover parts of the lower side of the core situated in between core grooves. It could be additionally advantageous in case a plurality of superficial suction holes is formed in at least a lower surface of said elastic material, wherein the superficial suction holes are open in a direction facing away from the core and substantially closed in a direction facing the core. More preferably, the superficial suction holes together define a void footprint, wherein material at the lower surface of the elastic material in between said superficial suction holes define a material footprint, wherein the ratio between the void footprint and the material footprint is at least 4, preferably at least 5, more preferably at least 6, thereby allowing the panel to be quickly (releasably) attached to a support surface and removed therefrom (without using glue). Hence, the elastic material provided with the suction holes constitutes a self-bonding material, which provides the panel as such a self-bonding property. Here, it is preferably that the thickness of the elastic material is preferably substantially equal to or (slightly) larger than the depth of the core groove(s). The elastic material is typically an elastic foam. In one embodiment, the elastic material is made from a foam material composed of ethylene vinyl acetate (EVA), which is a copolymer of ethylene and vinyl acetate, rubber, polyurethane (PU), polyethylene (PE), polypropylene (PP), polystyrene (PS), (plasticized) polyvinylchloride (PVC), or mixtures thereof. The elastic material may optionally include other components, such as a filler, such as chalk, talc, sand, fibre, wood, mineral, and/or carbon; a foaming agent, such as azodicarbonamide, a crosslinking agent, such as dicumyl peroxide, a foaming agent, such as zinc oxide; and/or a colouring agent. Preferably, the elastic material of the panel according to the present invention provides a rubber foam-like material with regard to softness and flexibility. The material has low-temperature toughness, stress-crack resistance, waterproof properties, air-tight sealing properties, and foam recovery after compression. In a preferred embodiment a number or substantially all of the suction holes have a diameter situated in between 5 μm to approximately 1 mm, preferably in between 10 μm and 500 μm, more preferably between 10 and 300 μm. The density of the elastic layer may vary along the thickness of the elastic layer. For example, the density of the elastic layer may range from about 30 kg/m3 to about 280 kg/m3. In another preferred embodiment, the diameter of the suction holes is between 1 μm and 450 μm, in particular between 2 μm and 400 μm, more in particular between 4 μm and 350 μm. Such distribution ensures an equal distribution of suction holes over the bottom surface of the tiles, with suitably shaped holes for suction, or attachment, onto the subsurface.

In an alternative imaginable and even preferable embodiment, at least a number of core grooves, preferably all core grooves are filled with a, typically strip-shaped, absorptive element, which absorptive element preferably includes a plurality of fibres which are at least partially impregnated with a pressure sensitive adhesive, preferably a hot melt pressure sensitive adhesive. Typically, the absorptive element is glued onto the core groove wall(s), by using a dedicated permanent adhesive, such as acrylate adhesive, PVC paste resins, epoxy glue, phenol glue, vinyl adhesive, polyurethane adhesive, amino resin adhesive, etcetera. The fibres are kept in place by, and may be implanted into, the permanent adhesive. The fibres may be cotton fibre, glass fibre, synthetic fibre, blended fibre, etcetera. The synthetic fibre may be viscose fibre, polyester fibre, nylon, polyacrylonitrile fibre, polyvinyl chloride fibre, polyvinyl alcohol fibre, etcetera. The blended fibre includes at least two different fibres in a single fibre strand or yarn, and the blended fibre may be a blend of e.g. polyester/cotton, nylon/wool, nylon/acetate, ramie/polyester, ramie/acrylic, wool/cotton, linen/cotton, linen/silk, linen/rayon, etcetera. The absorptive element typically includes a soft (flexible) substance with a Shore hardness in the range of 20°-60°. The soft substance preferably has a plurality of fine or wick structures such as fine pores or fine apertures which could be penetrated by fluid. The soft substance may be fibres or sponge. The thickness of the absorptive element is preferably substantially equal to or (slightly) larger than the depth of the core groove. Preferably, the absorptive element(s) is/are merely provided in the core grooves and are thus not provided at parts of the lower side of the core extending in between the core grooves. This allows the absorptive element to engage an underlying surface, in order to realize a bonding force between the panel and the underlying surface upon pushing the panel against the surface. Hence, also this embodiment provides the panel according to the invention self-bonding properties, without using separate glue.

The lower side (rear side) of the core may also constitute the lower side (rear side) of the panel as such. However, it is thinkable, and it may even be preferable, that the panel comprises a backing layer, either directly or indirectly, affixed to said lower said of the core. Typically, the backing layer acts as balancing layer in order to stabilize the shape, in particular the flatness, of the panel as such. Moreover, the backing layer typically contributes to the sound dampening properties of the panel as such. As the backing layer is typically a closed layer, the application of the backing layer to the lower side of the core will cover the core grooves at least partially, and preferably entirely. Here, the length of each core groove is preferably smaller than the length of said backing layer. The backing layer may be provided with cut-out portions, wherein at least a part of said cut-out portions overlap with at least one core groove. The at least one backing layer is preferably at least partially made of a flexible material, preferably an elastomer. The thickness of the backing layer typically varies from about 0.1 to 2.5 mm. Non-limiting examples of materials of which the backing layer can be at least partially composed are polyethylene, cork, polyurethane, polyvinylchloride, and ethylene-vinyl acetate. Optionally, the backing layer comprises one or more additives, such as fillers (like chalk), dyes, and/or one of more plasticizers. The thickness of a polyethylene backing layer is for example typically 2 mm or smaller. The backing layer may either be solid or foamed. A foamed backing layer may further improve the sound dampening properties. A solid backing layer may improve the desired balancing effect and stability of the panel.

The panel preferably comprises at least one reinforcement layer and/or reinforcing particles, which preferably extend(s) (and is/are present) in only one coupling profile of the first and second coupling profile, and extend(s) (and is/are present) in only one coupling profile of the third and fourth coupling profile. This means that at least two coupling profiles are reinforced and at least two other coupling are not reinforced by the reinforcement layer and/or reinforcing particles. The reinforcing particles may be separate reinforcing particles dispersed within the core. The reinforcing layer may, for example, by formed by a closed layer, a woven layer, or a non-woven layer. Suitable materials for realizing the reinforcement layer and/or reinforcement particles are glass, polymer, carbon, and metal.

In a preferred embodiment, the first coupling profile and/or the third coupling profile comprises: an upward tongue, at least one upward flank lying at a distance from the upward tongue, an upward groove formed in between the upward tongue and the upward flank wherein the upward groove is adapted to receive at least a part of a downward tongue of a second coupling profile of an adjacent panel, and at least one first locking element, preferably provided at a distant side of the upward tongue facing away from the upward flank, and wherein the second coupling profile and/or the fourth coupling profile comprises: a first downward tongue, at least one first downward flank lying at a distance from the downward tongue, a first downward groove formed in between the downward tongue and the downward flank, wherein the downward groove is adapted to receive at least a part of an upward tongue of a first coupling profile of an adjacent panel, and at least one second locking element adapted for co-action with a first locking element of an adjacent panel, said second locking element preferably being provided at the downward flank.

Preferably, the first locking element comprises a bulge and/or a recess, and wherein the second locking element comprises a bulge and/or a recess. The bulge is commonly adapted to be at least partially received in the recess of an adjacent coupled panel for the purpose of realizing a locked coupling, preferably a vertically locked coupling. It is also conceivable that the first locking element and the second locking are not formed by a bulge-recess combination, but by another combination of co-acting profiled surfaces and/or high-friction contact surfaces. In this latter embodiment, the at least one locking element of the first locking element and second locking element may be formed by a (flat of otherwise shaped) contact surface composed of a, optionally separate, plastic material configured to generate friction with the other locking element of another panel in engaged (coupled) condition. Examples of plastics suitable to generate friction include:

- Acetal (POM), being rigid and strong with good creep resistance. It has a low coefficient of friction, remains stable at high temperatures, and offers good resistance to hot water;
- Nylon (PA), which absorbs more moisture than most polymers, wherein the impact strength and general energy absorbing qualities actually improve as it absorbs moisture. Nylons also have a low coefficient of friction, good electrical properties, and good chemical resistance;

Polyphthalamide (PPA). This high performance nylon has through improved temperature resistance and lower moisture absorption. It also has good chemical resistance;

Polyetheretherketone (PEEK), being a high temperature thermoplastic with good chemical and flame resistance combined with high strength. PEEK is a favourite in the aerospace industry;

Polyphenylene sulphide (PPS), offering a balance of properties including chemical and high-temperature resistance, flame retardance, flowability, dimensional stability, and good electrical properties;

Polybutylene terephthalate (PBT), which is dimensionally stable and has high heat and chemical resistance with good electrical properties;

Thermoplastic polyimide (TPI) being inherently flame retardant with good physical, chemical, and wear-resistance properties.

Polycarbonate (PC), having good impact strength, high heat resistance, and good dimensional stability. PC also has good electrical properties and is stable in water and mineral or organic acids; and Polyetherimide (PEI), maintaining strength and rigidity at elevated temperatures. It also has good long-term heat resistance, dimensional stability, inherent flame retardance, and resistance to hydrocarbons, alcohols, and halogenated solvents.

In the abovementioned embodiment, it is imaginable that the first coupling profile (and/or third coupling profile) and the second coupling profile (and/or fourth coupling profile) are configured such that in coupled condition a pretension is existing, which forces coupled panels at the respective edges towards each other, wherein this preferably is performed by applying overlapping contours of the first coupling profile (and/or third coupling profile) and the second coupling profile (and/or fourth coupling profile), in particular overlapping contours of downward tongue and the upward groove and/or overlapping contours of the upward tongue and the downward groove, and wherein the first coupling profile (and/or third coupling profile) and the second coupling profile (and/or fourth coupling profile) are configured such that the two of such panels can be coupled to each other by means of a fold-down movement and/or a vertical movement, such that, in coupled condition, wherein, in coupled condition, at least a part of the downward tongue of the second coupling profile (and/or fourth coupling profile) is inserted in the upward groove of the first coupling profile (and/or third coupling profile), such that the downward tongue is clamped by the first coupling profile (and/or third coupling profile) and/or the upward tongue is clamped by the second coupling profile (and/or fourth coupling profile).

In an embodiment of the panel according to the invention, the first coupling profile and/or the third coupling profile comprises: a sideward tongue extending in a direction substantially parallel to the upper side of the core, at least one second downward flank lying at a distance from the sideward tongue, and a second downward groove formed between the sideward tongue and the second downward flank, and wherein the second coupling profile and/or the fourth coupling profile comprises: a third groove configured for accommodating at least a part of the sideward tongue of the third coupling profile of an adjacent panel, said third groove being defined by an upper lip and a lower lip, wherein said lower lip is provided with an upward locking element, wherein the third coupling profile and the fourth coupling profile are configured such that two of such panels can be coupled to each other by means of a turning movement, wherein, in coupled condition: at least a part of the sideward tongue of a first panel is inserted into the third groove of an adjacent, second panel, and wherein at least a part of the upward locking element of said second panel is inserted into the second downward groove of said first panel.

It is conceivable that each first coupling profile and each third coupling profile is compatible—hence may co-act and interlock—with each second coupling profile and each fourth coupling profile. This may also apply in case interlocking coupling profiles do not have a completely complementary shape.

In a preferred embodiment, at least coupling profile, and preferably all coupling profiles, is/are at least partially formed by the core.

As indicated above, the core is preferably at least partially made of at least one polymer, in particular a thermoplastic material and/or a thermoset material, wherein, preferably, the core comprises a composite comprising at least one polymer, in particular a thermoplastic material and/or a thermoset material, and at least one non-polymeric material. Said non-polymeric material preferably at least one material selected from the group consisting of: steel, glass, polypropylene, wood, acrylic, alumina, curaua, carbon, cellulose, coconut, kevlar, nylon, perlon, rock wool, sisal, fique, a mineral filler, in particular chalk. This may further increase the strength of the panel and/or the water resistivity and/or the fireproof properties of the panel as such, and/or may lower the cost price of the panel as such.

A preferred thermoplastic material is PVC, PET, PP, PS or (thermoplastic) polyurethane (PUR). PS may be in the form of expanded PS (EPS) in order to further reduce the density of the panel, which leads to a saving of costs and facilitates handling of the panels. Preferably, at least a fraction of the polymer used may be formed by recycled thermoplastic, such a recycled PVC or recycled PUR. It is also imaginable that rubber and/or elastomeric parts (particles) are dispersed within at least one composite layer to improve the flexibility and/or impact resistance at least to some extent. It is conceivable that a mix of virgin and recycled thermoplastic material is used to compose at least a part of the core. Preferably, in this mix, the virgin thermoplastic material and the recycled thermoplastic material is basically the same. For example, such a mix can be entirely PVC-based or entirely PUR-based.

Preferably, the core comprises from 50% of its weight up to 100% of its weight of thermoplastic material. The core may comprise at least one plasticizer to increase the flexibility of the panel as such. In a preferred embodiment the areal density of the core is less than 9000 g/m2, preferably less than 6000 g/m2.

The core may also be at least partially made of magnesium oxide (magnesia) and/or magnesium hydroxide, in particular a magnesia cement. In case such a magnesia and/or magnesium hydroxide are used to compose at least a part of the core, it is preferable that the core comprises one or more fillers, such as cellulose based particles. These cellulose based particles are preferably dispersed in said magnesia cement. Preferably, the core comprises at least one reinforcement layer embedded in said magnesium (hydroxide) based layer. It has been found that the application of a magnesium oxide and/or magnesium hydroxide based composition, and in particular a magnesia cement, significantly improves the inflammability (incombustibility) of the decorative panel as such. Moreover, the relatively fireproof panel also has a significantly improved dimensional stability when subject to temperature fluctuations during normal use. Magnesia based cement is cement which is based upon magnesia (magnesium oxide), wherein cement is the reaction product of a chemical reaction wherein magnesium oxide has acted as one of the reactants. In the magnesia cement, magnesia may still be present and/or has undergone chemical reaction wherein another chemical bonding is formed, as will be elucidated below in more detail. Additional advantages of magnesia cement, also compared to other cement types, are presented below. A first additional advantage is that magnesia cement can be manufactured in a relatively energetically efficient, and hence cost efficient, manner. Moreover, magnesia cement has a relatively large compressive and tension strength. Another advantage of magnesia cement is that this cement has a natural affinity for—typically inexpensive—cellulose materials, such as plant fibres wood powder (wood dust) and/or wood chips; This not only improves the binding of the magnesia cement, but also leads a weight saving and more sound insulation (damping). Magnesium oxide when combined with cellulose, and optionally clay, creates magnesia cements that breathes water vapour; this cement does not deteriorate (rot) because this cement expel moisture in an efficient manner. Moreover, magnesia cement is a relatively good insulating material, both thermally and electrically, which makes the panel in particularly suitable for flooring for radar stations and hospital operating rooms. An additional advantage of magnesia cement is that it has a relatively low pH compared to other cement types, which all allows major durability of glass fibre either as dispersed particles in cement matrix and/or (as fiberglass) as reinforcement layer, and, moreover, enables the use other kind of fibres in a durable manner.

The decorative top structure preferably comprises at least one decorative layer and at least one transparent wear layer covering said decorative layer. The decorative top structure may additionally comprise at least one back layer situated in between said decorative layer and the core, wherein said back layer is preferably made of a vinyl compound. A lacquer layer or other protective layer may be applied on top of said wear layer. A finishing layer may be applied in between the decorative layer and the wear layer. The decorative layer will be visible and will be used to provide the panel an attractive appearance. To this end, the decorative layer may have a design pattern, which can, for example be a wood grain design, a mineral grain design that resembles marble, granite or any other natural stone grain, or a colour pattern, colour blend or single colour to name just a few design possibilities. Customized appearances, often realized by digital printing during the panel production process, are also imaginable. The decorative top structure may also be formed by a single layer. In an alternative embodiment, the decorative top structure is omitted, thus not applied, in the panel according to the invention. In this latter embodiment, the upper side of the core constitutes the upper side of the panel.

The decorative layer may be formed at least partially by a printed thermoplastic layer or printed thermoplastic film. The thermoplastic material is used can be of various nature, but commonly PVC or PUR is preferred as material. The decorative layer may also be formed by an ink layer printed, preferably digitally printed, either directly or indirectly onto the core. The decorative layer may at least partially made of at least one biobased material, such as a polymer, in particular PUR, based upon plant-based oils such as canola oil or castor oil. The decorative may additionally comprise mineral components such as chalk. This combines sustainability with extremely high levels of resilience for an improved panel performance in terms of acoustic properties, indentation resistance, etcetera.

The decorative top structure may also comprise and/or constitute a carpet base having pile yarns projecting upwardly therefrom. The pile yarns can be made from a number of natural or synthetic fibres. Many types of yarn are made differently though, wherein there are typically two main types of yarn: spun and filament. The yarns may be made of nylon but other suitable synthetic yarns such as polyester, polypropylene, acrylic or blends thereof can be employed. The carpet tile may be either rigid or flexible. It is also conceivable that the base is free of any yarn or fibres. The pile yarns may consist of loop piles. It is however also possible that the pile yarns consist of cut piles, twisted piles or any other suitable pile yarns in for example a level- or multilevel configuration. The loop piles are possibly synthetic yarns, such as nylon, polyester, polypropylene, acrylic or blends thereof. In the shown embodiment, the loop piles are tufted in the carpet base. The carpet base preferably also comprises a backing sheet, which can for example be a non-woven sheet, a woven sheet, a non-woven polyester sheet, a polypropylene sheet, a glass fibre scrim or tissue sheet or combinations thereof. The backing sheet typically acts as support structure (holding structure) for holding the yarns. To more efficiently bond the tufts in position on the carpet base, and in particular on the backing sheet, preferably a pre-coat layer is applied. This pre-coat layer can for example be a latex layer.

The panel thickness is typically situated in between 3 and 10 mm, preferably between 4 and 8 mm.

Preferably, the core grooves run substantially parallel. Preferably, the total surface area of the groove openings covers at least 20%, preferably at least 30%, more preferably at least 40%, of the total surface area of the lower side of the core.

Preferably, at least panel edge is at least partially formed by at least one core edge, and wherein, preferably, each panel edge is at least partially formed by a core edge. It is imaginable that the decorative structure additionally also defined at least a part of the panel edge, or all panel edges.

The core is preferably extended along an extrusion direction, and wherein the grooves extend in said extrusion direction. Thus, the core grooves preferably extend in the extrusion direction.

The invention also relates to a decorative covering, in particular a decorative floor covering, decorative ceiling covering, or decorative wall covering, comprising a plurality of mutually coupled decorative panels according to the invention.

The invention further relates to a core for use in a panel according to the invention, wherein said core comprises: an upper side and a lower side, a first core edge comprising a first coupling profile, and a second core edge comprising a second coupling profile being designed to engage interlockingly with said first coupling profile of an adjacent panel, both in horizontal direction and in vertical direction, a third core edge comprising a third coupling profile, and a fourth core edge comprising a fourth coupling profile being designed to engage interlockingly with said third coupling profile of an adjacent panel, both in horizontal direction and in vertical direction, wherein each core edge defines a vertical plane (VP) perpendicular to a horizontal plane (HP), which horizontal plane (HP) is parallel to the core, wherein the core is provided with at least two vertically extending core grooves having a groove opening connected to the lower side and/or upper side of the core, wherein the entire part of the core grooves is arranged inside the vertical planes (VP) respectively defined by all core edges, such the core grooves do not intersect any coupling profile of the first coupling profile, the second coupling profile, the third coupling profile, and the fourth coupling profile, wherein each core groove is defined by at least one groove wall, wherein the core and the core grooves are formed by means of an extrusion process, such that the lower side and/or upper side of the core and the groove walls of the core grooves have substantially the same surface texture. In an alternative embodiment of the core, an upper side and/or lower side of the core is provided with core grooves during extrusion, wherein the core is not or not yet provided with any coupling profiles, or wherein the core is provided with only two complementary coupling profiles located at opposite panel edges.

The invention additionally relates to a method of producing a decorative panel, in particular a decorative panel according to the invention, comprising the steps of: A) liquifying a polymer based core composition; B) extruding said liquified polymer based core composition to form a liquified core of the panel; C) creating into the liquified core at least two vertically extending core grooves having a groove opening connected to the lower side and/or upper side of the core, such that the core grooves do not intersect any edge of the core; D) allowing the core to solidify; E) applying a decorative top structure, either directly or indirectly, onto the upper side of the core, such that a decorative panel or decorative plate is formed; and F) machining the panel edges, such that a first panel edge is provided with a first coupling profile, and a second panel edge is provided with a second coupling profile being designed to engage interlockingly with said first coupling profile of an adjacent panel, preferably both in horizontal direction and in vertical direction, and such that a third panel edge is provided with a third coupling profile, and a fourth panel edge comprising a fourth coupling profile being designed to engage interlockingly with said third coupling profile of an adjacent panel, preferably both in horizontal direction and in vertical direction. During the liquification of the polymer during step A), the polymer will become viscous and paste-like, which also the polymer to be easily deformed. It is imaginable that step B) is executed prior to step C). It is also imaginable that step B) and step C) at least partially overlap in time.

During step B) the core is preferably extended along an extrusion direction, and wherein during step C) the grooves are created such that the grooves also extend in said extrusion direction.

During step B) use is typically made of an extruder, wherein said extruder comprises a die, wherein said die defines an exit opening for extruded core material. The die is also referred to as the mouth or discharge opening of the extruder.

In case step B) and step C) at least partially overlap in time, preferably during step B) use is made of an extruder, wherein said extruder comprises a die, wherein said die defines an elongated exit opening for extruded core material, and wherein said die is configured to adjust the shape of exit opening in order to create the core grooves into the lower side and/or upper side of the core. More preferably, said die comprises a stationary die part and a mobile die part co-acting with said stationary die part, such that the exit opening is deformable between a first state, wherein the exit opening has a substantially rectangular shape, and a second state, wherein at least a part of the exit opening has a profiled shape, in particular undulated and/or toothed shape, wherein the core grooves are created when the exit opening is situated in the second state. Preferably, the extruder comprises a control unit for alternatingly moving the movable die part with respect to the stationary die part, such that the exit opening is alternatingly deformed between said first state and said second state.

During step D), it is advantageous to actively cool down the extruded core, preferably by means of cooling water. Preferably, the method comprises step G), comprising sawing the decorative plate formed during step E) into decorative panels, wherein step G) is executed prior to step F). The decorative plate is also referred to as decorative slab. Creating a decorative plate (step E) which is followed by cutting (sawing) the plate into pieces (step G) and to subsequently profile these pieces (step F) to form the decorative panels is often very efficient from an economic and efficiency point of view, and therefore highly preferred in practice. Since the coupling profiles (formed during profiling) and the core grooves are spaced apart, or at least do not mutually intersect, the core grooves applied in the slab together form a discontinuous (interrupted) pattern to create sufficient space in between the core grooves, to cut the slab into pieces and to profile the edges. In case the core is made by means of extrusion, this would mean that conventional extrusion technology is not suitable to realize the core, as in this conventional extrusion technology the core grooves are formed during extrusion by pushing molten material and/or flowable material through an extruder die having a desired cross-section matching the core grooves to be formed by said die. This would result in a continuous grooves extending over the entire length of the slab. Cutting this profiled slab into pieces following by profiling of the edges of the pieces to form the panels, will always result in the core grooves extending across the entire panel length and thus weakening the coupling profiles. Hence, in case extrusion would be used to produce the panels, a modified extrusion process will have to be applied, wherein, for example, instead of a conventional stationary extruder die a modified extruder die will have to be applied, which is able to position-selectively create core grooves in the slab as well as to create position-selectively (ungrooved) spaces for subsequent cutting and profiling. This can e.g. be realised by applying a dynamic extruder die which has at least one moving shape-determining component which can be displaced during production of the slab between a first position, wherein the core grooves are created, and second position, wherein the core grooves are not created.

The invention also relates to an extruder for use in a method according to invention, wherein said extruder comprises a die, wherein said die defines an elongated exit opening for extruded core material, and wherein said die is configured to adjust the shape of exit opening in order to create the core grooves into the lower side and/or upper side of the core, and wherein the die preferably comprises a stationary die part and a mobile die part co-acting with said stationary die part, such that the exit opening is deformable between a first state, wherein the exit opening has a substantially rectangular shape, and a second state, wherein at least a part of the exit opening has a profiled shape, in particular undulated and/or toothed shape, wherein the core grooves are created when the exit opening is situated in the second state, and wherein the extruder more preferably comprises a control unit for alternatingly moving the movable die part with respect to the stationary die part, such that the exit opening is alternatingly deformed between said first state and said second state.

The ordinal numbers used in this document, like "first", "second", and "third" are used only for identification purposes. Hence, the use of the expressions "third locking element" and "second locking element" does therefore not necessarily require the co-presence of a "first locking element".

The tiles of the tile system according to the invention may also be referred to as panels. The base layer may also be referred to as core layer. The coupling profiles may also be referred to as coupling parts or as connecting profiles. By "complementary" coupling profiles is meant that these coupling profiles can cooperate with each other. However, to this end, the complementary coupling profiles do not necessarily have to have complementary forms. By locking in "vertical direction" is meant locking in a direction perpendicular to the plane of the tile. By locking in "horizontal direction" is meant locking in a direction perpendicular to the respective coupled edges of two tiles and parallel to or falling together with the plane defined by the tiles. In case in this document reference is made to a "floor tile" or "floor panel", these expressions may be replaced by expressions like "tile", "wall tile", "ceiling tile", "covering tile". In the context of this document, the expressions "foamed composite" and "foamed plastic material" (or "foam plastic material") are interchangeable, wherein in fact the foamed composite comprises a foamed mixture comprising at least one (thermos)plastic material and at least one filler (non-polymeric material).

BRIEF DESCRIPTION OF THE DRAWINGS

The invention will be elucidated on the basis of non-limitative exemplary embodiments shown in the following figures. Herein show.

Within these figure, similar references refer to similar or equivalent features or elements.

DESCRIPTION OF THE INVENTION

Figure 1A:
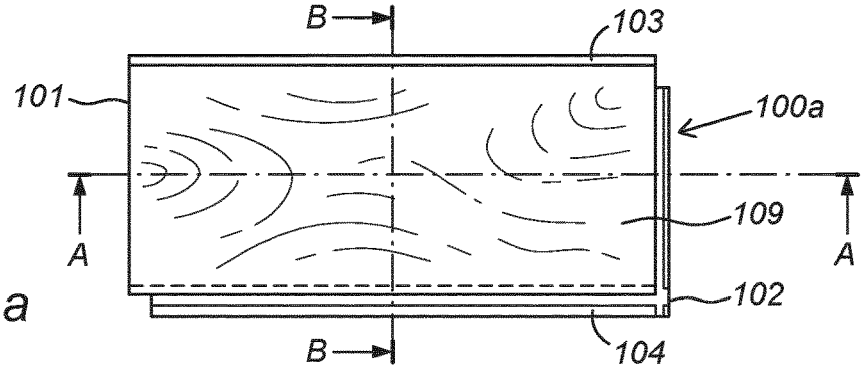
FIGS. 1*a*-1*e* a top and bottom view of schematic representation of possible embodiments of decorative panels according to the present invention.

FIGS. 1*a*-1*e* show schematic representations of possible embodiments of decorative panels 100*a*-100*e* according to the present invention. The shown panels 100*a*-100*e* are rectangular and oblong in this example. In practice, the panels 100*a*-100*e* may have an alternative shape, such as square, hexagon, or octagonal. FIG. 1*a* shows a top view of the panel, which may be used for each of the panel embodiments shown in FIGS. 1*b*-1*e*. More in particular, FIGS. 1*b*-1*e* show a bottom view of different panels 100*b*-100*e*. Each panel 100*a*-100*e* comprises a core 105 comprising a first panel edge comprising a first coupling profile 101, and a second panel edge comprising a second coupling profile 102 being designed to engage interlockingly with said first coupling profile 101 of an adjacent panel, both in horizontal direction and in vertical direction. This first set of coupling profiles 101, 102 is positioned at opposite short edges of the panel 100*a*-100*e*. The coupling profiles 101, 102 are configured to be coupled by means of a fold-down movement and/or a vertical movement, and these coupling profiles 101, 102 are also referred to as "push-lock" coupling profiles as they can be pushed (and/or hammered) into each other. Each panel 100*a*-100*e* further comprises a third panel edge comprising a third coupling profile 103, and a fourth panel edge comprising a fourth coupling profile 104 being designed to engage interlockingly with said third coupling profile 103 of an adjacent panel, both in horizontal direction and in vertical direction. This second set of coupling profiles 103, 104 is positioned at opposite long edges of the panel 100*a*-100*e*. The coupling profiles 103, 104 are configured to be coupled by means of an angling-down movement and/or a rotational movement, and these coupling profiles 103, 104 are also referred to as "angling-down" coupling profiles. The push-lock coupling profiles 101, 102 and the angling-down coupling profiles 103, 104 may be identical to the coupling profiles 5, 6, 7, 8 as shown in FIGS. 1-3 of European patent EP3105392, the subject-matter of which European patent is incorporated in this document by reference. Each panel 100*a*-100*e* comprises a plurality core grooves provided in the lower side of the core 105, wherein each core groove 106 is defined by at least one groove wall. The groove wall makes (integral) part of the core 105. The core 105 and the core grooves 106 are formed by means of an extrusion process, simultaneously and/or successively. By forming both the core 105 and the grooves 106 during extrusion, the lower side of the core and the groove walls W of the core grooves typically have substantially the same surface texture. The surface texture of the lower side of the core and the surface texture of the core grooves may mutually differ, but since both the lower side of the core and the core grooves are formed by means of extrusion, the surface texture will be relatively smooth and free of dust and (mill) shavings compared to the surface texture of milled core grooves (milled in the core after completion of the extrusion process of the core). FIG. 1*a* shows that the panel 100*a* comprises a decorative top structure 109, which is affixed, directly or indirectly, on an upper side of the core of the panel 100*a*. The decorative structure 109 shown is a non-limiting example of a decorative structure. Typically, the coupling profiles 101, 102, 103, 104 are realized by milling the laminated assembly of the core 105 and the affixed decorative structure 109.

FIGS. 1-*b*-1*e* shows different core groove configurations provided in the lower side of the core 105. As mentioned above the core grooves 106 are applied in the core when the core is still in a liquified (viscous or paste-like) state. This could be realised by an extruding device which may have an adjustable die and/or directly downstream the extruding device when the core is still sufficiently liquid (viscous or paste-like) and deformable to shape the core grooves 106.

Figure 1B:
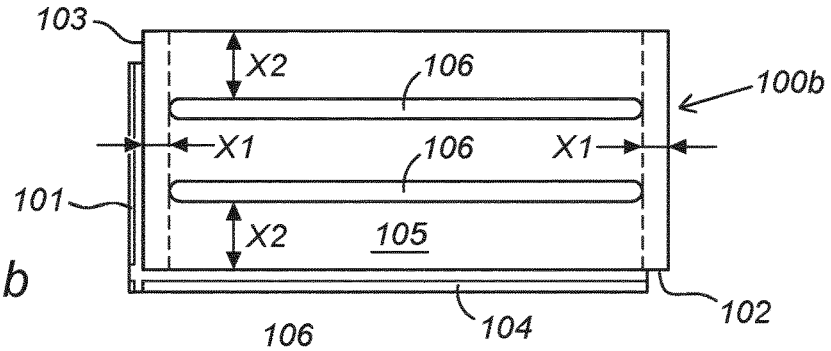

FIG. 1*b* shows that the core 105 is provided with two vertically extending core grooves 106 having a groove opening connected to the lower side of the core 105, wherein the entire part of the core grooves 106 is arranged inside the vertical planes respectively defined by all panel edges, such that the core grooves 106 do not intersect any coupling profile of the first coupling profile 101, the second coupling profile 102, the third coupling profile 103 and the fourth coupling profile 104. The core grooves 106 are positioned at a distance from all coupling profiles 101, 102, 103, 104, schematically indicated by reference signs X1, X2. This means that the core grooves 106 are provided in a center portion of the core 105, and that a peripheral (edge) portion of the core 106, being provided with the coupling profiles 101, 102, 103, 104, is free of any core grooves 106. The result of this core grooves orientation is that the core 105 is a relatively light-weight core, wherein the core 105 may also have a limited thickness, for example between 2 and 10 mm, and wherein the coupling profiles 101, 102, 103, 104 are designed in a relatively robust manner, and can therefore operate in a relatively reliable and durable manner.

Figure 1C:
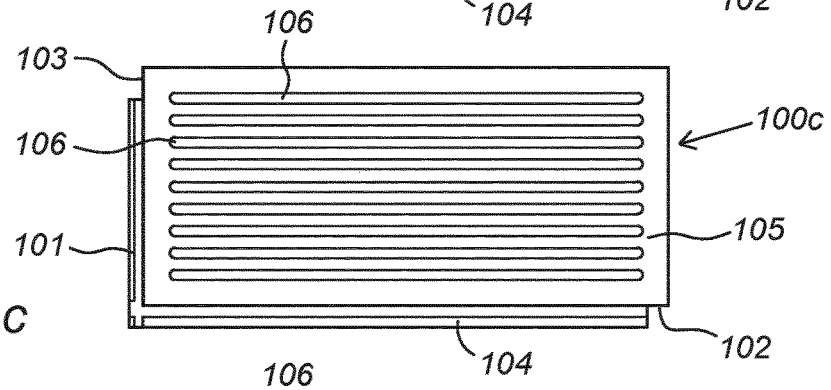

FIG. 1*c* shows a further possible structure of the core 105 of the panel 100*c*. The core 105 is provided with multiple (parallel) core grooves 106. All core grooves 106 are uninterrupted. The dimension of the core grooves 106 may be identical, though may also vary (on purpose) in practice.

Figure 1D:
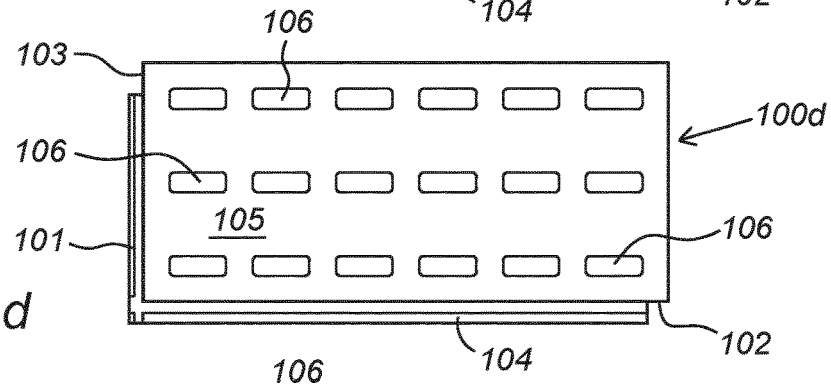
Figure 1E:
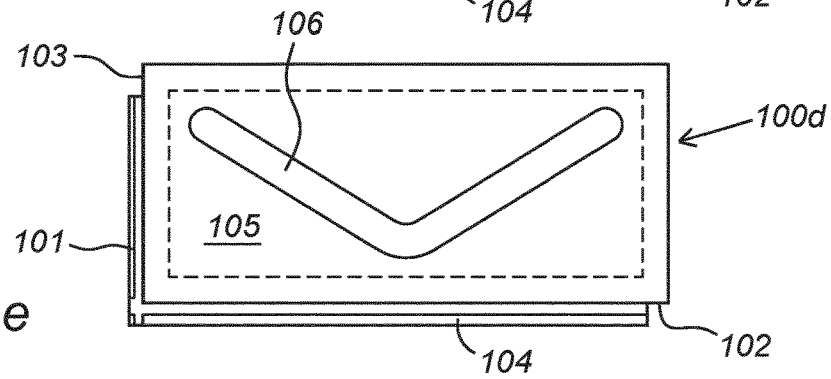
Figure 4B:
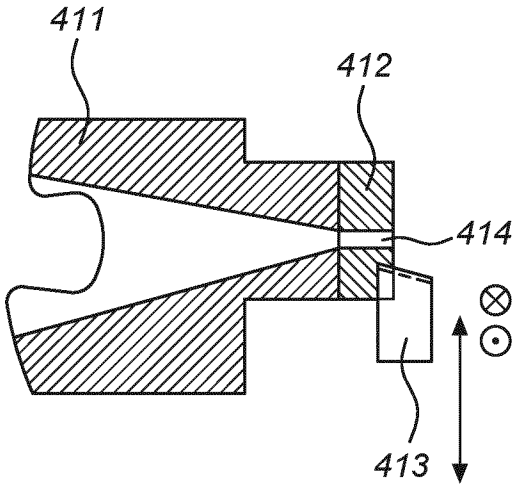
FIGS. 4*a* and 4*b* a schematic representation of an extruder which can be used for manufacturing a decorative panel according to the present invention.
Figure 4A:
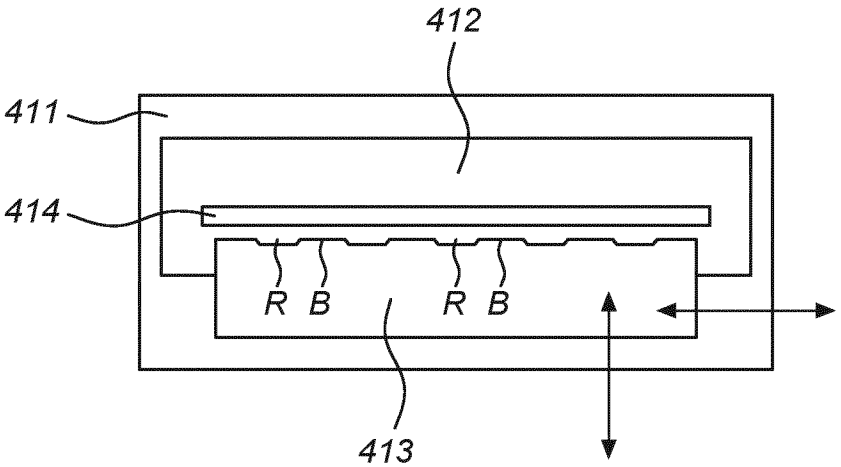

FIG. 1*d* show structure of the core 105 of a panel 100*d* wherein the core comprises multiple discontinuous core grooves 106. FIG. 1*e* shows a structure of the core 105 of a panel 100*e* wherein the core comprises one core groove 106. The core groove 106 has, in the depicted bottom view, a V-shape over the length of the panel 100*e*. This structure can be manufactured by making use of an extruder, for example as shown in FIGS. 4*a* and 4*b*, where the extruder comprises at least one displaceable mould which is displaceable in both a horizontal and a vertical direction. Hence, different shapes of the core grooves 106 can be provided.

FIGS. 2*a*-2*d* show a schematic representation of a cross section of a decorative panel 200*a*-200*d* according to the present invention. The cross section shown in these FIGS. 2*a*-2*d* could, for example, be the cross section of the panel according to line A-A shown as in FIG. 1*a*. Hence, in FIGS. 2*a*-2*d* the push-lock profiles of the panel are shown.

The figures show the first panel edge comprising a first coupling profile 201, and a second panel edge comprising a second coupling profile 202 which are designed to engage interlockingly with said first coupling profile 201 of an adjacent panel. The cross section shown is typically the so-called long-side of the panel 200*a*-200*d*. Each panel 200*a*-200*d* comprises a core 205 which is provided with core groove(s) 206. Each panel 200*a*-200*d* defines a horizontal plane (HP) being parallel to the core 205 of the panel, which is only visualized in FIG. 2*a*. Each coupling profile 201, 202 defines two vertical planes (VP), and more in particular the first coupling profile 201 defines a vertical outer plane (VP-O1), which coincides with a top outer edge of the first coupling profile 201, and also defines a vertical inner plane (VP-I1), which coincides with a bottom outer edge of the first coupling profile 201. The second coupling profile 202 defines a vertical outer plane (VP-O2), which coincides with a bottom outer edge of the second coupling profile 202, and also defines a vertical inner plane (VP-I2), which coincides with a top outer edge of the second coupling profile 202. In coupled condition of two panels 200*a*, VP-01 of a first panel will coincide with VP-I2 of a second panel and VP-I1 of said first panel will coincide with VP-O2 of said second panel. As mentioned in the above description, the outer edges (VP-O1, VP-O2) of the panel 200*a* are often also referred to a vertical plane V1. Additional vertical planes (VP2) can be identified which coincide with a part of a coupling profiles 201, 202, positioned closest to a centre portion of the core of the panel 200*a*. As can be seen, the core groove(s) 206 is/are positioned at a distance from each of the aforementioned vertical planes (VP-O1, VP-I1, VP-I2, VP-O2, VP1, VP2). The vertical planes are only visualized in FIG. 2*a* for clarity reasons, but are obviously also present in the further FIGS. 2*b*-2*d*. As can be seen in the FIGS. 2*a*-2*c*, the core grooves 206 are preferably located at a distance of all vertical planes defined above. It is, however, possible, as shown in FIG. 2*d* that the core grooves 206 are positioned at a distance of at least one vertical plane of each coupling profile 201, 202.

Figure 2A:
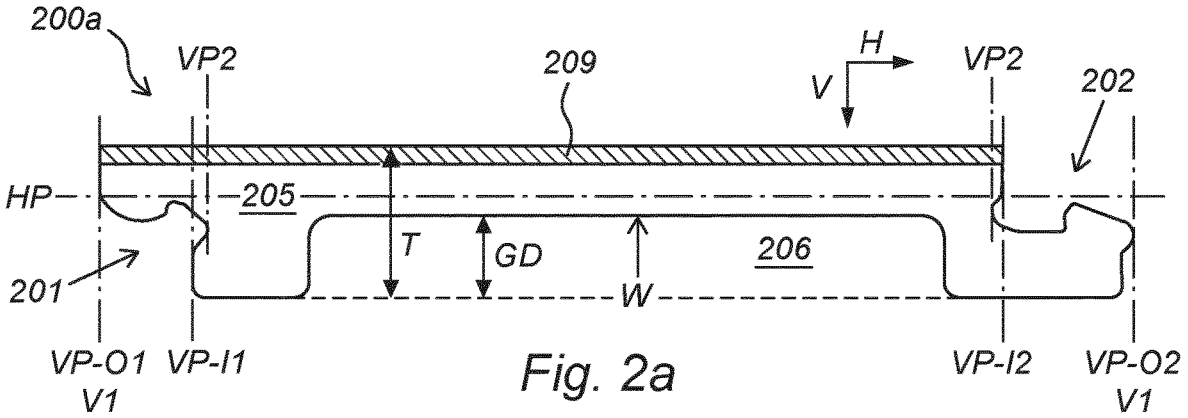
FIGS. 2*a*-2*d* a side view schematic representation of a cross section of possible embodiments of decorative panels according to the present invention.

The panel 200*a* shown in FIG. 2*a* comprises a decorative top structure 209. The panel 200*a* shows a relatively long and deep core groove 206 which almost extends over the entire length of the panel 200*a*. However, the core groove 206 starts at a predetermined distance from the panel edges such that the core grooves 206 do not intersect with the first coupling profile 101 and the second coupling profile 102. The core groove depth (GD) of the core groove 206 is more than 0.3 times the panel thickness (T). The lower side of the core and the groove walls of the core grooves 206 have a substantially smooth surface texture.

Figure 2B:
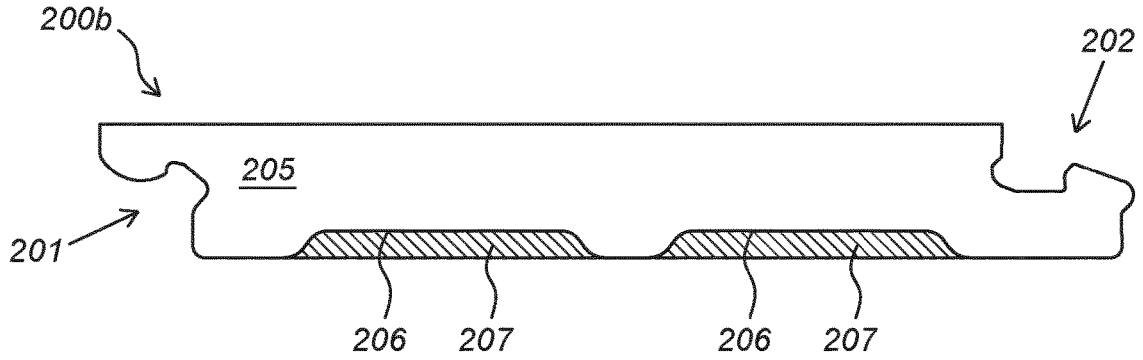

FIG. 2*b* shows a panel 200*b* comprising an interrupted, discontinuous core groove 206. This may enhance the stability of the panel 200*b*, for example when the panel is exposed to heavy loads. The core grooves 206 are filled with a material 207, in particular a sound-dampening material 207. The decorative top structure (not shown) is printed directly on top of the core 205 of the panel 200*b*.

Figure 2C:
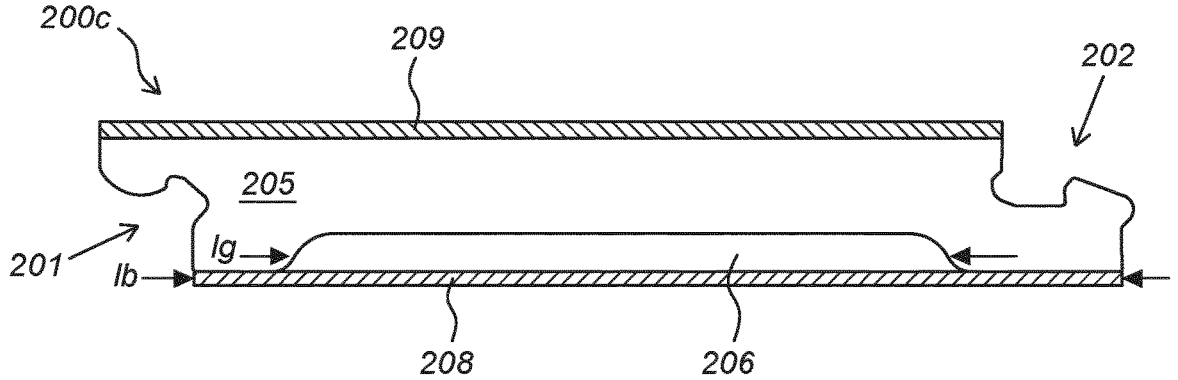
Figure 2D:
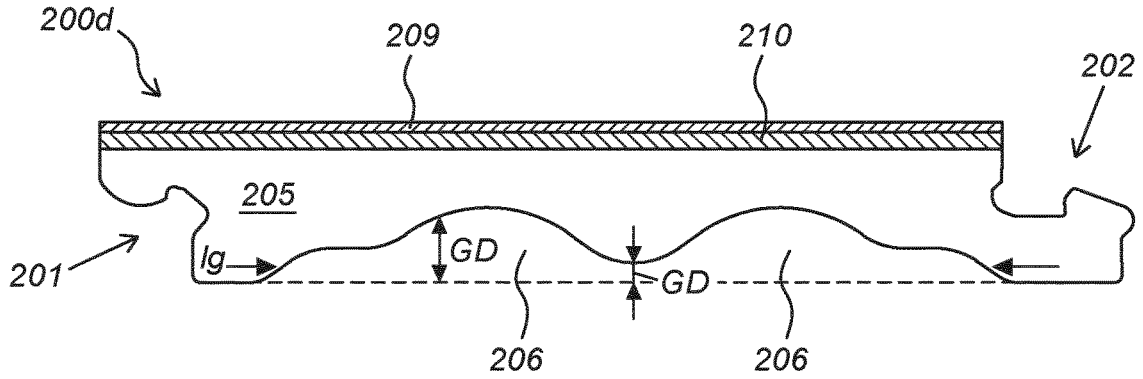

FIG. 2*c* shows a further embodiment of a panel 200*c* according to the present invention. The core groove 206 is shielded by a backing layer 208 which is affixed to the lower side of the core 205. It can be seen that the length lg of the core groove 206 is smaller than the length lb of said backing layer 208. Hence, the backing layer 208 substantially fully covers the core groove 206. It can be seen that the width of the groove opening of the core groove 206 is larger than the width of an inner part of said core groove. The core grooves 206 are air-filled. It is however also conceivable that the core grooves 206 are filled with any suitable filling material. The panel 200*c* further comprises a decorative top layer 209.

FIG. 2*d* shows another possible embodiment of a panel 200*d* according to the present invention. The panel comprises a core groove 206 wherein the core groove depth (GD) varies along the core groove length lg. The core groove 206 is in particular defined by two terminal portions enclosing a centre portion. The panel 200*d* further comprises a reinforcement layer 210 and a decorative top layer 209.

FIGS. 3*a*-3*d* show a schematic representation of a cross section of a decorative panel 300*a*-300*d* according to the present invention. The cross section shown in these FIGS. 3*a*-3*d* could, for example, be the cross section of the panel according to line B-B shown as in FIG. 1*a*. Hence, in FIGS. 3*a*-3*d* the angling down profiles of the panel are shown.

Each panel 300*a*-300*d* comprises a core 305 which is provided with core groove(s) 306. Each panel 300*a*-300*d* again defines a horizontal plane (HP) being parallel to the core 205 of the panel, which is only visualized in FIG. 3*a*, which could be the same horizontal plane (HP) as shown in FIG. 2*a*. Each coupling profile 301, 302 defines two vertical planes (VP), and more in particular the third coupling profile 301 defines a vertical outer plane (VP-O3), which coincides with a top outer edge of the third coupling profile 301, and also defines a vertical inner plane (VP-I3), which coincides with a bottom outer edge of the third coupling profile 301. The fourth coupling profile 302 defines a vertical outer plane (VP-O4), which coincides with a bottom outer edge of the fourth coupling profile 302, and which also defines a vertical inner plane (VP-I4), which coincides with a top outer edge of the fourth coupling profile 302. In coupled condition of two panels 300*a*, VP-O3 of a first panel will coincide with VP-I4 of a second panel and VP-I3 of said first panel will coincide with VP-O4 of said second panel. As mentioned in the above description, the outer edges (VP-O3, VP-O4) of the panel 300*a* are often also referred to a vertical plane V1. Additional vertical planes (VP2) can be identified which coincide with a part of a coupling profiles 303, 304 positioned closest to a centre portion of the core of the panel 300*a*. As can be seen, the core groove(s) 306 is/are positioned at a distance from each of the aforementioned vertical planes (VP-O3, VP-I3, VP-I4, VP-O4, VP1, VP2). The vertical planes are only visualized in FIG. 3*a* for clarity reasons, but could obviously be defined in the further FIGS. 3*b*-3*d*. As can be seen in the FIGS. 3*a*-2*d*, the core grooves 306 are preferably located at a distance of all vertical planes defined above. It is, however, possible that the core grooves 306 are positioned at a distance of at least one vertical plane of each coupling profile 301, 302, which alternative embodiment is not shown in FIGS. 3*a*-3*d*.

Figure 3A:
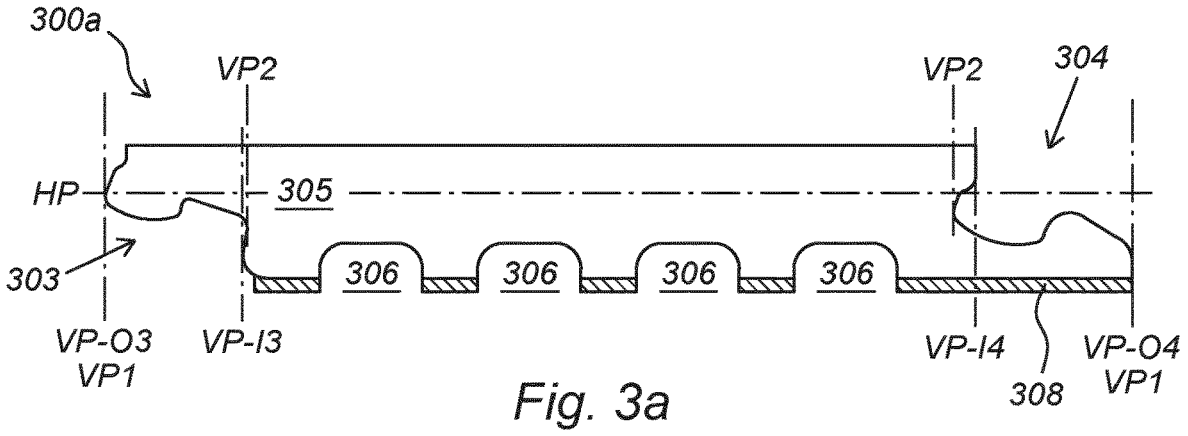
FIGS. 3*a*-3*d* a side view schematic representation of a cross section of possible embodiments of decorative panels according to the present invention.

FIG. 3*a* shows that the panel 300*a* comprises multiple core grooves 306 having a substantially equal width. The panel 300*a* comprises a backing layer 308 which is configured such that the core grooves 306 are not covered by the backing layer 308.

Figure 3B:
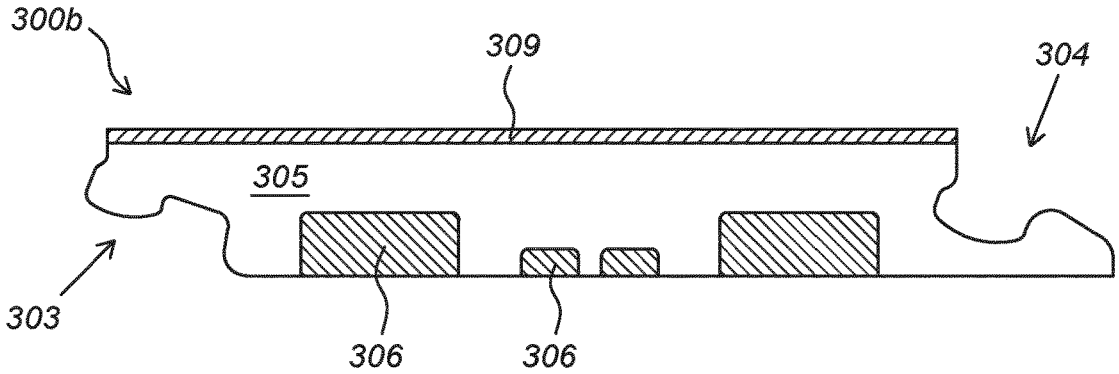
Figure 3C:
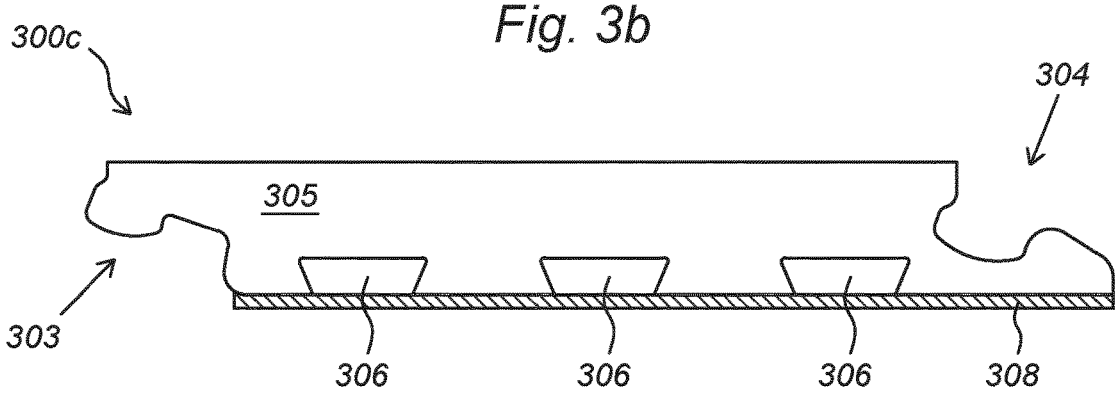

FIG. 3*b* shows a panel 300*b* comprising core grooves 306 wherein the outer core grooves 306 have a larger depth than the inner core grooves 306. Each groove core 306 is filled with a (sound- and/or impact dampening) material. The panel 300*b* further comprises a decorative top layer 309.

The panel 300*c* shown in FIG. 300*c* comprises core grooves 306 wherein the width of the opening of the core groove 306 is smaller than the width of a further, inner part of the core groove 306. The backing layer 308 substantially fully covers the core grooves 306. The core grooves 306 are air-filled.

Figure 3D:
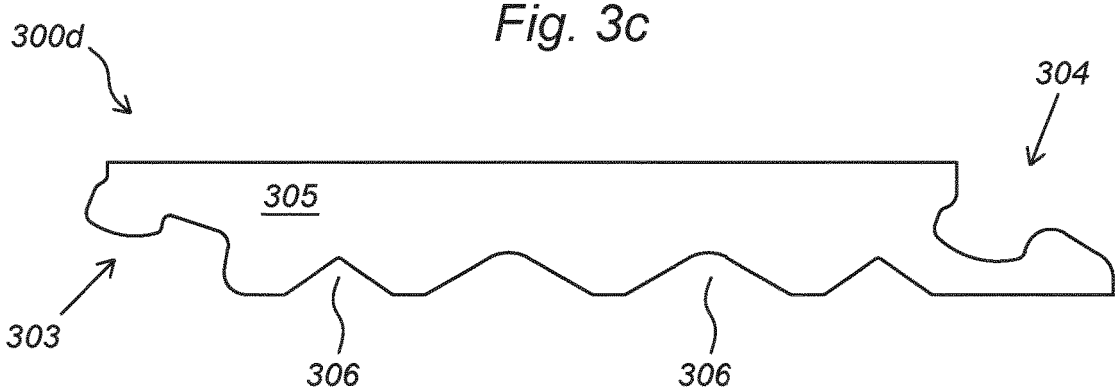

FIG. 3*d* shows a panel 300*d* comprising core grooves 306 wherein the width of the opening of the core groove 306 is larger than the width of an inner part of said core groove 306.

FIGS. 4*a* and 4*b* shows a schematic representation of an extruder 411 which can be used for manufacturing a decorative panel according to the present invention. FIG. 4*a* shows a front view, where FIG. 4*b* shows a side view. Both figures show a cross section. The extruder 411 comprises a first mould 412 and a second mould 413. The second mould 413 is displaceable with respect to the first mould 412. The arrows indicates the direction of displacement of the second mould 413. The second mould 413 can in a preferred embodiment be displaced in both a vertical and horizontal direction. This enables a large variety of possible core groove patterns which can be obtained. Reference 414 shows the opening 414 of the first mould 412 which provides for the formation of a panel during the extrusion. The first mould 412 can be a conventional mould as used in an extruder for the manufacturing of panels and/or plate like structures. The extruder 411 according to present invention comprises at least one displaceable second mould 413, which is configured to provide at least two vertically extending core grooves. In the shown embodiment, the second mould 413 comprises a structure provided multiple recesses R and bulges B (or teeth/protrusions) which are configured to provide a structured pattern to the panel, in particular a grooved surface of the lower side (and/or upper side) of the core of the panel. Hence, the core grooves are provided in the panel during the extrusion of the core. Since the second mould 413 is displaceable, it is possible to provide a panel wherein the entire part of each core grooves is arranged inside the vertical planes of the panel, respectively defined by all panel edges, such the core grooves do not intersect any coupling profiles which are to be provided afterwards. A further benefit of the core and the core grooves being formed by means of an extrusion process is that the lower side of the core and the groove walls of the core grooves have substantially the same surface texture. It is also conceivable that the extruded 411 comprises multiple second moulds, in order to provide multiple and/or different core grooves within the panel.

Hence, the above-described inventive concepts are illustrated by several illustrative embodiments. It is conceivable that individual inventive concepts may be applied without, in so doing, also applying other details of the described example. It is not necessary to elaborate on examples of all conceivable combinations of the above-described inventive concepts, as a person skilled in the art will understand numerous inventive concepts can be (re)combined in order to arrive at a specific application. It is, for example, imaginable that the invention of creating core grooves in an upper side and/or lower side of a core during extrusion may also be used to create light-weight panels, in particular floor panels, which are not provided with coupling profiles at all or which are provided with only two complementary coupling profiles located at opposite panel edges. In this alternative panel configuration, the decorative structure will typically be affixed, either directly or indirectly, to an upper side of the core. This alternative panel may be used for example as floor panel, wall panel, and/or ceiling panel. Various embodiments of the panel as described above and in the appended claims may be combined with this alternative panel configuration.

It will be apparent that the invention is not limited to the working examples shown and described herein, but that numerous variants are possible within the scope of the attached claims that will be obvious to a person skilled in the art.

The verb "comprise" and conjugations thereof used in this patent publication are understood to mean not only "comprise", but are also understood to mean the phrases "contain", "substantially consist of", "formed by" and conjugations thereof.

The invention claimed is:

1. A decorative panel, comprising:

a core provided with an upper side and a lower side, wherein the core is at least partially made of at least one thermoplastic material, a decorative top structure, either directly or indirectly, affixed on said upper side of the core, a first panel edge comprising a first coupling profile, and a second panel edge comprising a second coupling profile being designed to engage interlockingly with said first coupling profile of an adjacent panel, both in horizontal direction and in vertical direction, a third panel edge comprising a third coupling profile, and a fourth panel edge comprising a fourth coupling profile being designed to engage interlockingly with said third coupling profile of an adjacent panel, both in horizontal direction and in vertical direction, wherein each panel edge defines at least one vertical plane (VP) perpendicular to a horizontal plane (HP), which horizontal plane (HP) is parallel to the core, wherein the core is provided with at least two vertically extending core grooves having a groove opening connected to the lower side and/or upper side of the core, wherein the entire part of the core grooves is arranged inside the vertical planes (VP) respectively defined by all panel edges, such that the core grooves do not intersect any coupling profile of the first coupling profile, the second coupling profile, the third coupling profile, and the fourth coupling profile, wherein each core groove is defined by at least one groove wall, wherein the core is an extruded core having a smooth surface finish without spines or protrusions, and wherein the core grooves are extruded core grooves having a smooth surface finish without spines or protrusions, and wherein (i) the lower side and/or upper side of the core and (ii) the groove walls of the core grooves have substantially the same smooth surface finish.

2. The panel according to claim 1, wherein the core groove depth (GD) of at least one core groove is at least 0.3 times a panel thickness (T).

3. The panel according to claim 1, wherein the width of the groove opening of at least one core groove is larger than the width of an inner part of said core groove.

4. The panel according to claim 1, wherein at least one core groove is a discontinuous core groove.

5. The panel according to claim 1, wherein at least two core grooves have mutually different shapes.

6. The panel according to claim 1, wherein the panel comprises a backing layer affixed to said lower side of the core.

7. The panel according to claim 1, wherein the panel comprises at least one reinforcement layer, which extends in only one coupling profile of the first and second coupling profile, and in only one coupling profile of the third and fourth coupling profile.

8. The panel according to claim 1, wherein the core is at least partially made of at least one polymer.

9. The panel according to claim 1, wherein the areal density of the core is less than 9000 g/m2.

10. The panel according to claim 1, wherein the decorative top structure comprises at least one digitally printed decorative layer and at least one transparent wear layer covering said decorative layer.

11. The panel according to claim 1, wherein the total surface area of the groove openings covers at least 20%, of the total surface area of the lower side of the core.

12. The panel according to claim 1, wherein at least one panel edge is at least partially formed by at least one core edge.

13. The panel according to claim 1, wherein the core comprises a centre portion and a peripheral portion enclosing said centre portion, wherein the panel edges and coupling profiles make part of said peripheral portion, and wherein said peripheral portion is free of core grooves.

14. The panel according to claim 1, wherein at least one panel edge is configured to define a plurality of vertical planes (VP), wherein one vertical plane (VP1) coincides with the outer part of a panel edge and at least one other vertical plane (VP2) coincides with a part of a coupling profile of said edge, positioned closest to a centre portion of the core of the panel.

15. The panel according to claim 1, wherein the core grooves are positioned at a distance from each vertical plane.

16. A decorative covering, comprising a plurality of mutually coupled decorative panels according to claim 1.

17. The panel according to claim 1, wherein the core grooves are extruded core grooves having a smooth surface finish without spines or protrusions that are present in milled core grooves.

18. The panel according to claim 1, wherein the lower side and/or upper side of the core and the groove walls of the core grooves have substantially the same surface texture.

19. A core for use in a panel, wherein said core comprises:

an upper side and a lower side, wherein the core is at least partially made of at least one thermoplastic material, a first core edge comprising a first coupling profile, and a second core edge comprising a second coupling profile being designed to engage interlockingly with said first coupling profile of an adjacent panel, both in horizontal direction and in vertical direction, a third core edge comprising a third coupling profile, and a fourth core edge comprising a fourth coupling profile being designed to engage interlockingly with said third coupling profile of an adjacent panel, both in horizontal direction and in vertical direction, wherein each core edge defines a vertical plane (VP) perpendicular to a horizontal plane (HP), which horizontal plane (HP) is parallel to the core, wherein the core is provided with at least two vertically extending core grooves having a groove opening connected to the lower side and/or upper side of the core, wherein the entire part of the core grooves is arranged inside the vertical planes (VP) respectively defined by all core edges, such the core grooves do not intersect any coupling profile of the first coupling profile, the second coupling profile, the third coupling profile, and the fourth coupling profile, wherein each core groove is defined by at least one groove wall, wherein the core is an extruded core having a smooth surface finish without spines or protrusions, wherein the core grooves are extruded core grooves having a smooth surface finish without spines or protrusions, and wherein the lower side and/or upper side of the core and the groove walls of the core grooves have substantially the same surface texture, and wherein (i) the lower side and/or upper side of the core and (ii) the groove walls of the core grooves have substantially the same smooth surface finish.

20. The core according to claim 19, wherein the core grooves are extruded core grooves having a smooth surface finish without spines or protrusions that are present in milled core grooves.

* * * * *